US009177731B2

(12) United States Patent
Cloran et al.

(10) Patent No.: US 9,177,731 B2
(45) Date of Patent: Nov. 3, 2015

(54) FLEXIBLE CABLE ASSEMBLY FOR HIGH-POWER SWITCH GEAR

(71) Applicant: ROCKWELL AUTOMATION TECHNOLOGIES, INC, Mayfield Heights, OH (US)

(72) Inventors: Shawn D. Cloran, Wauwatosa, WI (US); Edward Byaliy, Mequon, WI (US); Jerry M. Watkins, Franklin, WI (US); Scott B. Lasko, Pewaukee, WI (US); James P. Miller, Waukesha, WI (US); Christopher J Wieloch, Brookfield, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 191 days.

(21) Appl. No.: 14/078,187

(22) Filed: Nov. 12, 2013

(65) Prior Publication Data

US 2015/0131208 A1 May 14, 2015

(51) Int. Cl.

| | |
|---|---|
| ***H01H 3/02*** | (2006.01) |
| ***H01H 3/20*** | (2006.01) |
| ***H01H 9/22*** | (2006.01) |
| ***H01H 3/38*** | (2006.01) |

(52) U.S. Cl.

CPC . *H01H 3/02* (2013.01); *H01H 3/20* (2013.01); *H01H 3/38* (2013.01); *H01H 9/22* (2013.01)

(58) Field of Classification Search

CPC ..... H01H 3/02; H01H 3/20; H01H 3/38; H01H 9/262; H01H 9/282; G05G 1/00; Y10T 307/74; H02B 1/38

USPC ..... 361/601, 602, 605, 622, 627, 631, 641, 361/643; 200/50.02, 50.33, 50.14, 330, 200/331, 332, 329, 337, 334; 335/68–72, 335/202; D13/110–112, 122–133, D13/158–161, 184

See application file for complete search history.

(56) References Cited

U.S. PATENT DOCUMENTS

| | | | | |
|---|---|---|---|---|
| 3,939,725 | A * | 2/1976 | Fisher | 74/503 |
| 4,626,638 | A * | 12/1986 | Samples et al. | 200/331 |
| 5,193,666 | A * | 3/1993 | Markowski et al. | 200/331 |
| 5,272,296 | A * | 12/1993 | Robarge et al. | 200/331 |
| 5,428,196 | A | 6/1995 | Beatty, Jr. et al. | |
| 5,973,279 | A * | 10/1999 | Turner et al. | 200/331 |
| 6,504,460 | B2 * | 1/2003 | DeGrazia et al. | 335/68 |
| 6,590,756 | B2 * | 7/2003 | Meiners et al. | 361/62 |
| 6,642,463 | B1 * | 11/2003 | Turner | 200/331 |
| 6,710,697 | B1 * | 3/2004 | Houck, III | 337/196 |

* cited by examiner

*Primary Examiner* — Michail V Datskovskiy
(74) *Attorney, Agent, or Firm* — Boyle Fredrickson, S.C.

(57) ABSTRACT

A remote switching system for electronic switches in a cabinet provides an actuator assembly communicating through a flexible cable with a door handle. The actuator assembly on the electronic switch provides a rotatably captive threaded fastener holding the sheath of the flexible cable to the actuator assembly allow ring a simple single-point tuning of the actuator operation. This tuning may be facilitated by a visual scale showing relative positions between the actuator assembly and an internal slider communicating with the operator of the electronic switch.

19 Claims, 6 Drawing Sheets

FIG. 11
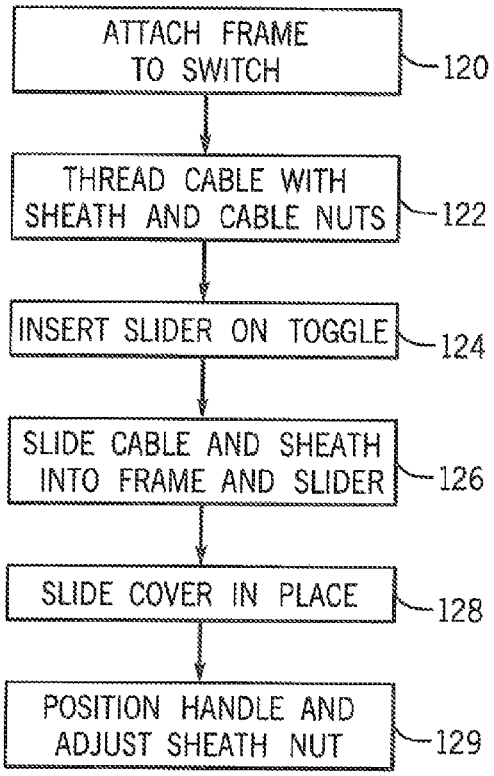
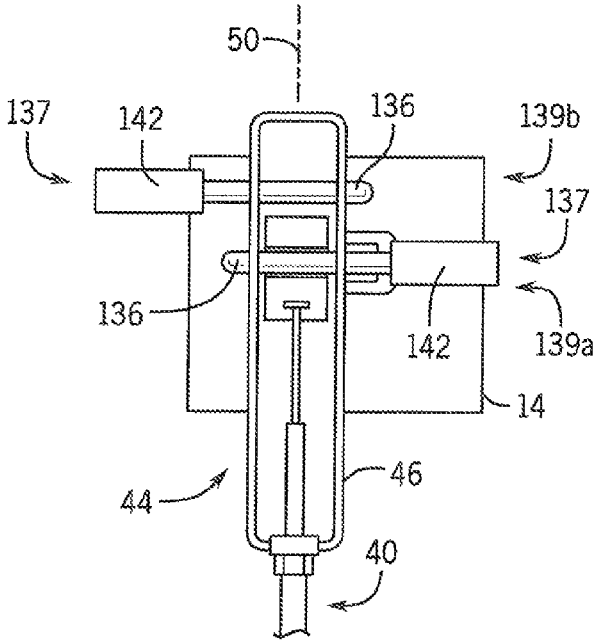
FIG. 12
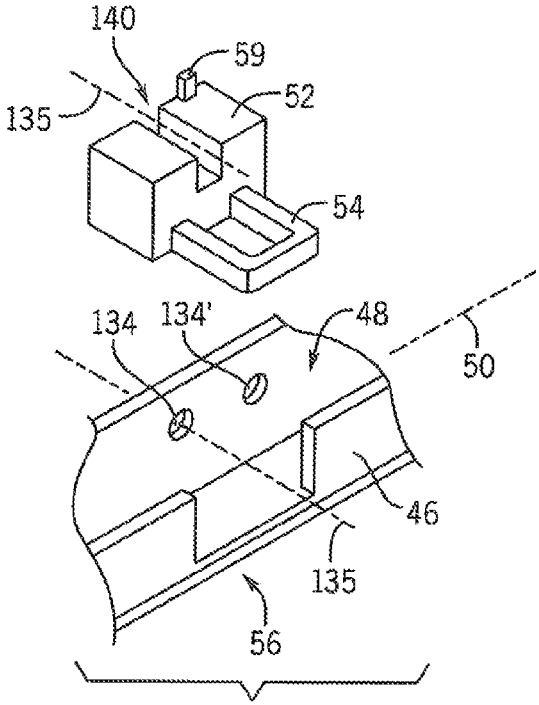
FIG. 13
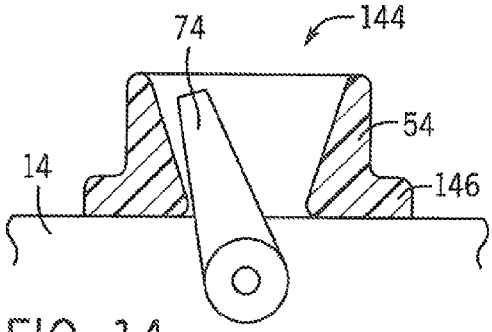
FIG. 14

FLEXIBLE CABLE ASSEMBLY FOR HIGH-POWER SWITCH GEAR

BACKGROUND OF THE INVENTION

The present invention relates to high-power electrical switches, and in particular to a flexible cable operator for remotely actuating electrical switches such as circuit breakers.

High-power electrical circuitry is normally placed inside a metal cabinet to protect the electrical circuitry from the external environment and to shield users from potential hazards associated with the operation of the circuitry.

Often the cabinet provides a handle that serves both to lock a cabinet door and to disconnect electrical power from the interior circuitry before the door is opened. The handle may communicate through a flexible cable operator with a switch inside the cabinet, for example, a circuit breaker, so that when the handle is moved to allow opening of the cabinet door, the circuit breaker is also opened, removing electrical power from the interior circuitry. This feature is normally subject to the mechanical override in the event that the cabinet must be operated with the door open and the circuitry live.

A flexible cable operator provides a substantially incompressible sheath through which a flexible cable may slide. Opposite ends of the sheath are fixed respectively to a stationary structure of the handle and an actuator frame attached to the circuit breaker housing. One end of the cable is then attached to a movable portion of the handle to communicate this motion through the cable to a slider held within the actuator frame. The slider may provide a collar receiving a toggle operator of the circuit breaker to move the circuit breaker toggle between an "on" and "off" position with movement of the flexible cable by the handle.

The flexible cable must normally be "tuned" so that the motion at the circuit breaker is sufficient to move the circuit breaker toggle fully between on and off positions when the handle is moved between on and off positions. This tuning is normally accomplished by adjusting a pair of opposed "jam nuts" attached to a threaded barrel on one end of the flexible cable sheath. The jam nuts capture a flange of the actuator frame between them. By loosening one nut and tightening the other, the point of attachment of the sheath to the stationary actuator framework may be shifted to properly center the actuation range of the flexible cable with respect to the operating range of the circuit breaker toggle.

Adjusting these jam nuts can be relatively difficult requiring partial disassembly of the actuator framework and working within the close confines of that framework to loosen and tighten these two nuts. Once the end of the sheath is properly positioned, the two jam nuts must be tightened together using torque-controlled tools to ensure that the connection does not inadvertently loosen during vibration or use and to ensure that the torque is not so high as to damage the threaded barrel on the end of the sheath causing the sheath to separate from the actuator.

After moving the jam nuts, it can be difficult to determine whether the adjustment is correct because the handle may not be operated with the jam nuts loose such as would allow the sheath to move freely in this position tested. Accordingly multiple trials may be required for proper adjustment.

SUMMARY OF THE INVENTION

The invention provides an improved actuator allowing single point adjustment of the attachment of the flexible cable sheath to the actuator housing, eliminating the need to loosen, adjust and tighten pairs of jam nuts to precise torques. A visual gauge may be provided to assist in this adjustment process.

Specifically, the invention provides a switching apparatus for an electrical switch of the type that may be disposed in a cabinet, where the electrical switch has a toggle operator extending from a front of a housing of the electrical switch movable along an actuation axis to switch the electrical switch between an on and off state. The invention includes an actuator frame that can be attached to the housing of the electrical switch proximate to the toggle operator and a slider held by the actuator frame to slide along the actuation axis. The slider provides a collar receiving the toggle operator when the stationary actuator frame is fixed to the housing of the electrical switch, so that movement of the slider along the actuation axis may switch the toggle operator between the on and off states. An actuator cable has an outer sheath and inner flexible cable, and a first end of the outer sheath is attached to one end of the actuator frame so that the inner flexible cable may extend from the first end along the actuation axis, and a first end of the inner flexible cable attached to the slider may move the slider with movement of the inner flexible cable. The attachment between the first end of the outer sheath and the actuator frame provides a threaded ferrule at the first end of the actuator sheath receiving a threaded fastener. A portion of the threaded fastener is received within a pocket on the actuator frame sized to permit rotation of the threaded fastener about the threaded ferrule within the pocket while preventing translation of the threaded fastener along the axis with respect to the actuator frame.

It is thus a feature of at least one embodiment of the invention to eliminate the need for complex adjustment of jam nuts in tuning a remote actuator for an electronic switch.

The threaded fastener may provide a substantially circular disk portion having opposed faces abutting corresponding opposed faces of the pocket.

It is thus a feature of at least one embodiment of the invention to provide an engagement surface that offers low resistance rotation even in the presence of translated forces.

The threaded fastener may include a nut portion coaxially attached to the circular disk portion and providing wrench-engaging flats.

It is thus a feature of at least one embodiment of the invention to provide a separate feature better optimized to the different requirements of turning the threaded fastener and retaining the threaded fastener.

The nut portion is a hex nut with three-quarter inch separated flats (19 mm).

It is thus a feature of at least one embodiment of the invention to provide a nut fitting standard English and metric wrenches for ready field adjustment.

The pocket may provide a U-shaped slot conforming to an outer periphery of the substantially circular disk portion of the threaded fastener.

It is thus a feature of at least one embodiment of the invention to provide an engagement feature in the actuation frame that offers good support to the threaded fastener as may be implemented in a thermoplastic material or the like.

The switching apparatus may further include an actuator frame cover fitting over the pocket to retain the circular disk portion within the pocket and the nut portion may extend axially beyond the actuator frame and actuator frame cover when fitting over the pocket to be accessible with a wrench.

It is thus a feature of at least one embodiment of the invention to retain and protect the components of the actuator assembly while allowing ready tuning of the actuator assembly in its assembled form. By combining a nut feature with a captured flange, the nut may be fully exposed for access.

At least one of the actuator frame and actuator frame cover may provide a viewable scale proximate to a fiducial feature of the slider, the scale indicating a first range of positions of the slider corresponding to switching of the toggle operator in the on state and a second range of positions corresponding to switching of the toggle operator in the off state.

It is thus a feature of at least one embodiment of the invention to provide immediate visual guidance of the information needed to properly tune the actuator assembly when it is in its fully assembled state.

The first range of operator positions may be marked in red with at least one of the symbols for I and on and the second range of operator positions is marked in green with at least one of the symbols for O, off, or reset.

It is thus a feature of at least one embodiment of the invention to provide a visual indicator that also functions to indicate state and proper operation of the actuator assembly.

The scale may further provide a range of positions between the first and second range of positions indicating the position where the toggle operator is not well defined in either of the on or off state.

It is thus a feature of at least one embodiment of the invention to guide the operator when tuning the actuator assembly to a tuning that insures proper operation even in the face of manufacturing tolerance stack up.

The scale may be on the actuator frame cover and the fiducial feature may be a finger extending from the slider through a slot in the actuator frame cover or along either left or right sides of the frame cover adjacent to the viewable scale.

It is thus a feature of at least one embodiment of the invention to provide an indication of operating status of the actuator assembly that may be readily viewed in most installation configurations and that directly reveals the state of the internal slider.

The actuator frame cover may engage the actuator frame by an axial slidable engagement of corresponding hooks.

It is thus a feature of at least one embodiment of the invention to provide a tuning system that accommodates some axial position tolerance implicit in a sliding engagement system.

At least a portion of the threaded fastener may be exposed through the assembled actuator frame cover and actuator frame at a position to be manipulated by a user viewing the scale.

It is thus a feature of at least one embodiment of the invention to allow the scale to be used during the tuning operation.

The actuator frame may be injected molded thermoplastic.

It is thus a feature of at least one embodiment of the invention to provide a design that accommodates fabrication and an electrically nonconductive polymer.

The actuator frame may include outer flange portions having holes for receiving machine screws to attach the actuator frame to the electrical switch.

It is thus a feature of at least one embodiment of the invention to provide a mounting system that accommodates a variety of different electrical switches while positively locating the actuator assembly with respect to the electrical switch simplified assembly in tuning.

The above aspects of the invention are not intended, to define the scope of the invention for which purpose claims are provided. In the following description, reference is made to the accompanying drawings, which form a part hereof and in which there is shown by way of illustration, and not limitation, a preferred embodiment of the invention. Such embodiment does not define the scope of the invention and reference must be made therefore to the claims for this purpose.

BRIEF DESCRIPTION OF THE DRAWINGS

Reference is hereby made to the following figures in which like reference numerals correspond to like elements throughout, and in which:

FIG. 11 is a flowchart of the manufacturing steps for assembling the switching system in one embodiment of the present invention;

FIG. 12 is a schematic representation of the actuator assembly and electronic switch showing alternative locations for a padlock for locking the slider and electronic switch in the off position;

FIG. 13 is an exploded perspective view of the actuator frame and slider showing multiple positions of locking holes and an optional slot in the slider; and FIG. 14 is a cross-sectional view through the collar of the slider taken along line 14-14 of FIG. 3 showing its funnel-like opening.

DETAILED DESCRIPTION OF THE INVENTION

Figure 1:
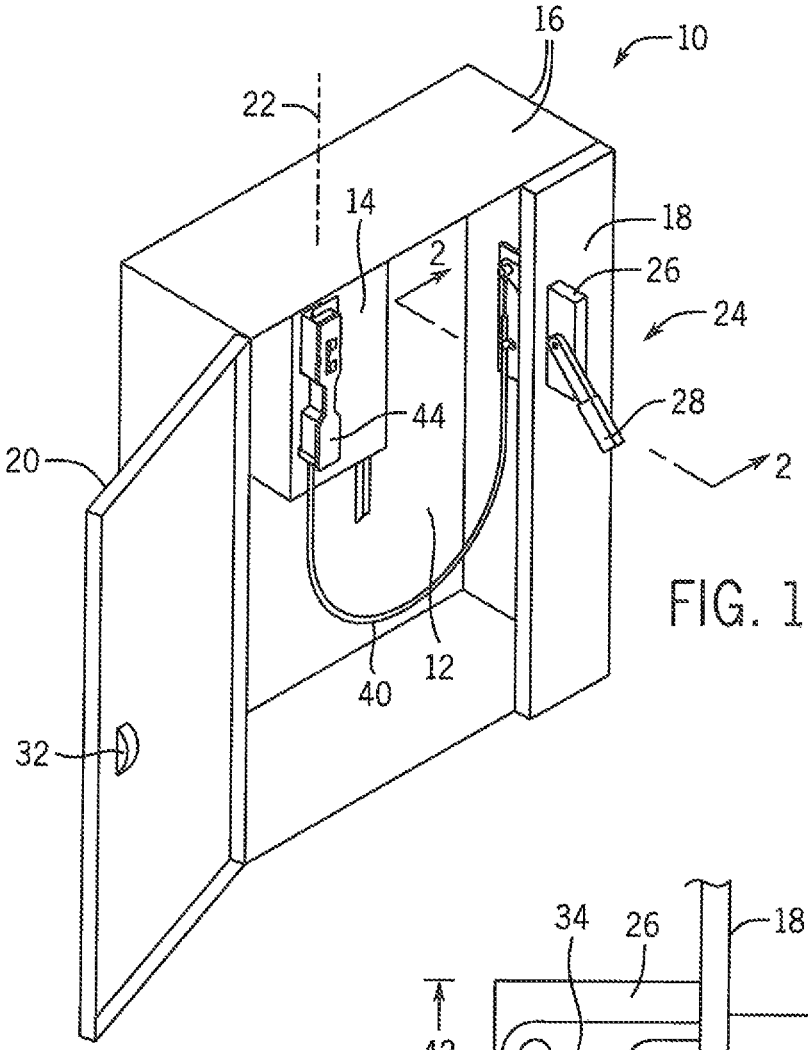
FIG. 1 is a simplified perspective view of an open electrical cabinet showing an exterior accessible handle assembly communicating by a flexible cable with an actuator assembly on an electrical switch.

Referring now to FIG. 1, an electronics cabinet 10, for example, constructed of sheet steel, may provide a generally rectangular rear wall 12 to which electrical equipment may be attached including an electrical switch 14 such as a circuit breaker, disconnect switch, or the like. Top and side walls 16 of the electronic cabinet 10 extend forward from the periphery of the rear wall 12 and may be covered by a combination of the front panel 18 and door 20 to define a cabinet interior. The door 20 may hinge between open and closed position, for example, alone, a hinge axis 22 at a front vertical edge of left side wall 16.

The front panel 18 may be fixed to one edge of the cabinet 10 against a left side wall 16 and spanning an upper and lower side wall 16 and may support a handle assembly 24. The handle assembly 24 may include a frame 26 supporting a pivoting handle 28 which may swing between an upper "on" position and a lower "off" position (the latter shown in FIG. 1) as manipulated by a user.

Figure 2:
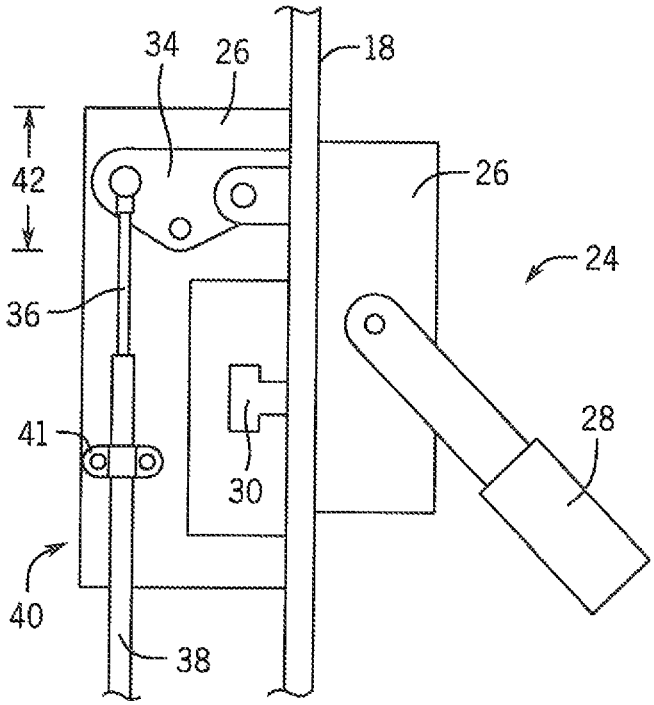
FIG. 2 is a side elevational view of the handle assembly showing attachment of the flexible cable to that assembly.

Referring also to FIG. 2, as is generally understood in the art, in the lower "off" position, a latch lever 30 interacting with a latch strike 32 on the door 20 may allow opening of the door 20 from a closed position. Conversely, when the handle 28 is in the upper "on" position, the latch lever 30 may interact with the latch strike 32 to hold the door closed in a locked position.

Generally, the movable handle 28 controls an actuation linkage 34 attached to a portion of the handle frame 26 inside the cabinet 10. This actuation linkage 34 in turn may be attached to a flexible cable 36 fitting within a tubular cable sheath 38 together forming a flexible cable assembly 40. The end of the sheath at the handle assembly 24 may be fixed by a clamp 41 to the handle frame 26 so that movement of the actuation linkage 34 by the handle 28 slides the flexible cable 36 within the sheath 38.

As is generally understood in the art, the flexible cable 36 and tubular cable sheath 38 may be relatively freely flexed across their axes of extension but are substantially resistant to changes in dimension in tension or compression along their axes of extension to efficiently transmit the relative motion between the flexible cable 36 and the sheath 38 to a remote location. Generally, motion of the handle 28 through its entire range will provide for a relative movement between the flexible cable 36 and the cable sheath 38 of a predefined distance 42 as will be discussed further below. The actuation linkage 34 controls the relationship between the movement of the handle 28 and the desired predefined distance 42 of the flexible cable 36.

Referring again to FIG. 1, flexible cable assembly 40 may pass through the interior of the cabinet 10 to an actuator assembly 44 attached to a front face of the electronic switch 14.

Figure 3:
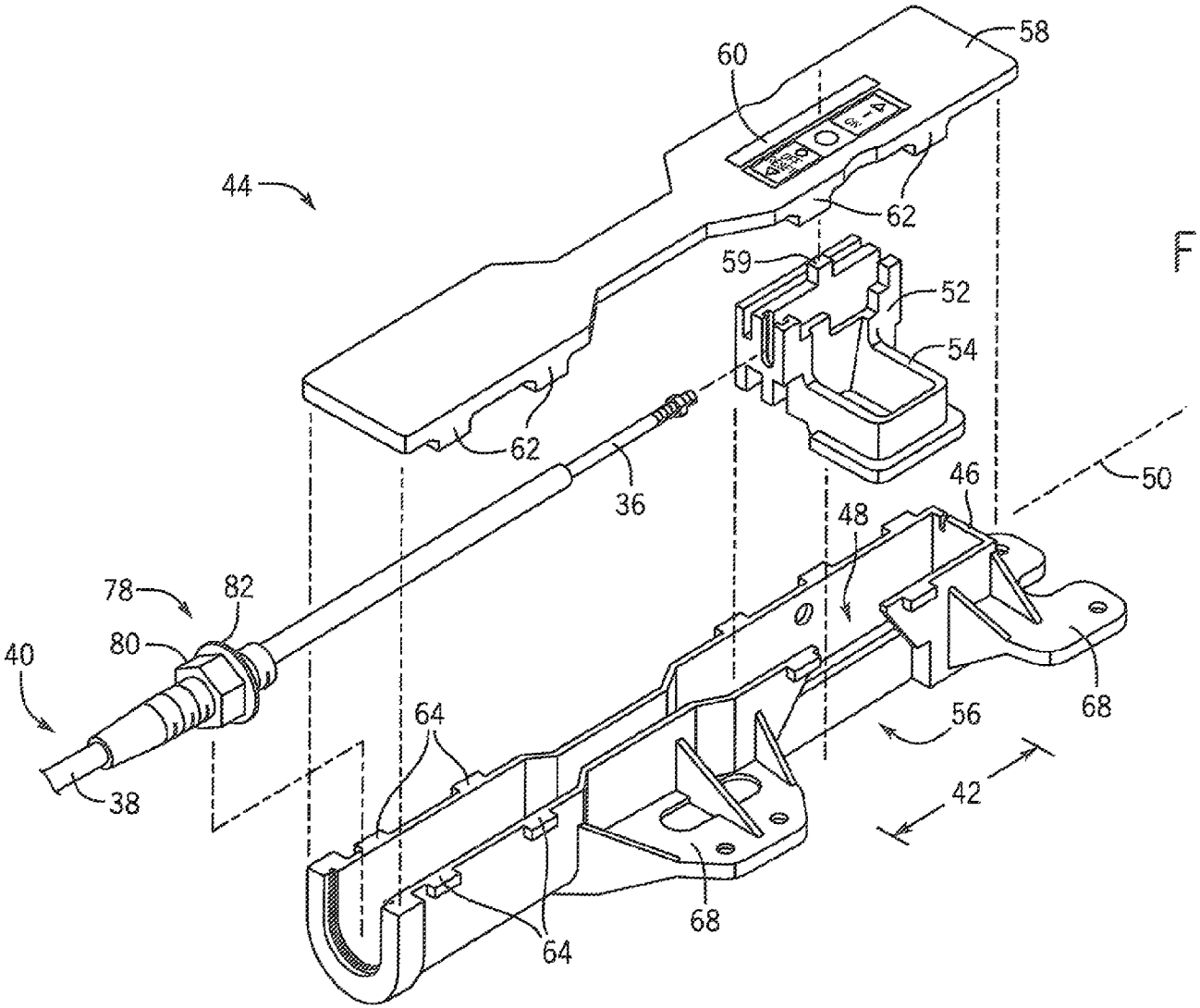
FIG. 3 is an exploded perspective view of the actuator assembly showing the components of an actuator frame, a slider, and a cover as may together secure an end of the flexible cable.

Referring now to FIG. 3, the actuator assembly 44 generally provides an actuator frame 46 presenting a generally upwardly open channel 48 extending along an actuation axis 50. A slider 52 may fit in an upper length of the channel 48 to slide therealong and may provide a sidewardly extending collar 54 projecting through an opening 56 in the side wall of the channel of the actuator frame 46. The size of the opening 56 is such as to permit the slider 52 to slide at least by the predefined distance 42 described above.

The cable assembly 40 may attach to a lower end of the actuator frame 46 (as will be discussed below) so that the flexible cable 36 extending through the sheath 38 may pass into the channel 48 along the actuation axis 50 to attach to the slider 52. As so assembled, movement of the flexible cable 36 will move the slider 52 along the actuation axis 50 within the actuation frame 46.

When the slider 52 is within the channel 48 and the cable assembly 40 attached to the actuator frame 46, an actuator frame cover 58 may be installed to cover the upper opening of the channel 48 and a portion of the cable assembly 40 within that channel 48. With the actuator frame cover 58 in place, the collar 54 remains uncovered, projecting from the side of the actuation frame 46.

A fiducial feature 59 of the slider 52 may project upward through a slot 60 in the actuator frame cover 58 so that the relative position of the slider 52 within the actuation frame 46 may be visually determined through the actuator frame cover 58. Generally, the actuator frame cover 38 may be attached to the actuation frame 46 by sliding engagement between a set of downwardly extending hooks 62 on the actuator frame cover 58 and laterally outwardly extending hooks 64 at an upper edge of the channel 48 of the actuator frame 46, as will be discussed in more detail below.

Figure 4:
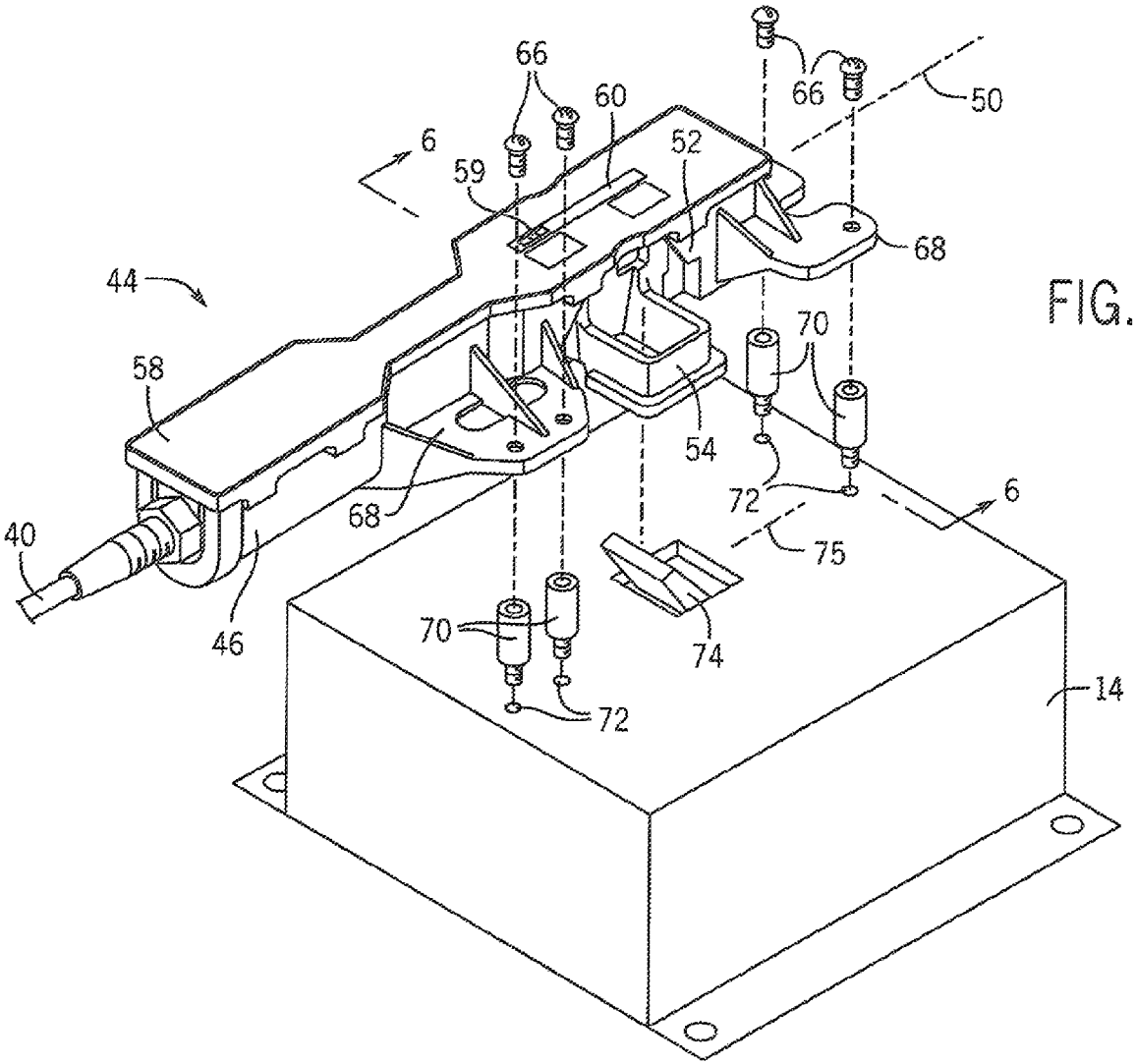
FIG. 4 is an exploded view of the assembled actuator assembly positioned with respect to the electronic switch for attachment thereto.

Referring also to FIG. 4, the actuator frame 46 may be attached to a front face of the electrical switch 14 by means of machine screws 66 passing through holes in horizontally extending flanges 68 in the actuator frame 46 and then through standoffs 70 to threaded bores 72 in the front face of the switch 14. When the actuator frame 46 is so attached, the collar 54 of the slider 52 surrounds an upwardly extending toggle operator 74 of the electrical switch 14 that may swing or toggle along a toggle operation axis 75. The toggle operation axis 75 is aligned with the actuation axis 50 of the actuator frame 46 when the actuator frame 46 is attached to the housing of the electrical switch 14.

This inter-engagement of the toggle operator 74 is such as to allow movement of the slider 52 and collar 54 to fully actuate electrical switch 14, moving the toggle operator 74 between an "on" position in which electrical current is conducted through the electrical switch 14 and "off" position in which electrical current is interrupted, when the slider 52 moves by the predefined distance 42.

Each of the slider 52, actuator frame cover 58, and actuator frame 46 may be constructed of injection molded thermoplastic having a high electrical dielectric to resist electrical conduction through these components to the flexible cable 36 should electrical power be applied to any of these components.

Figure 5:
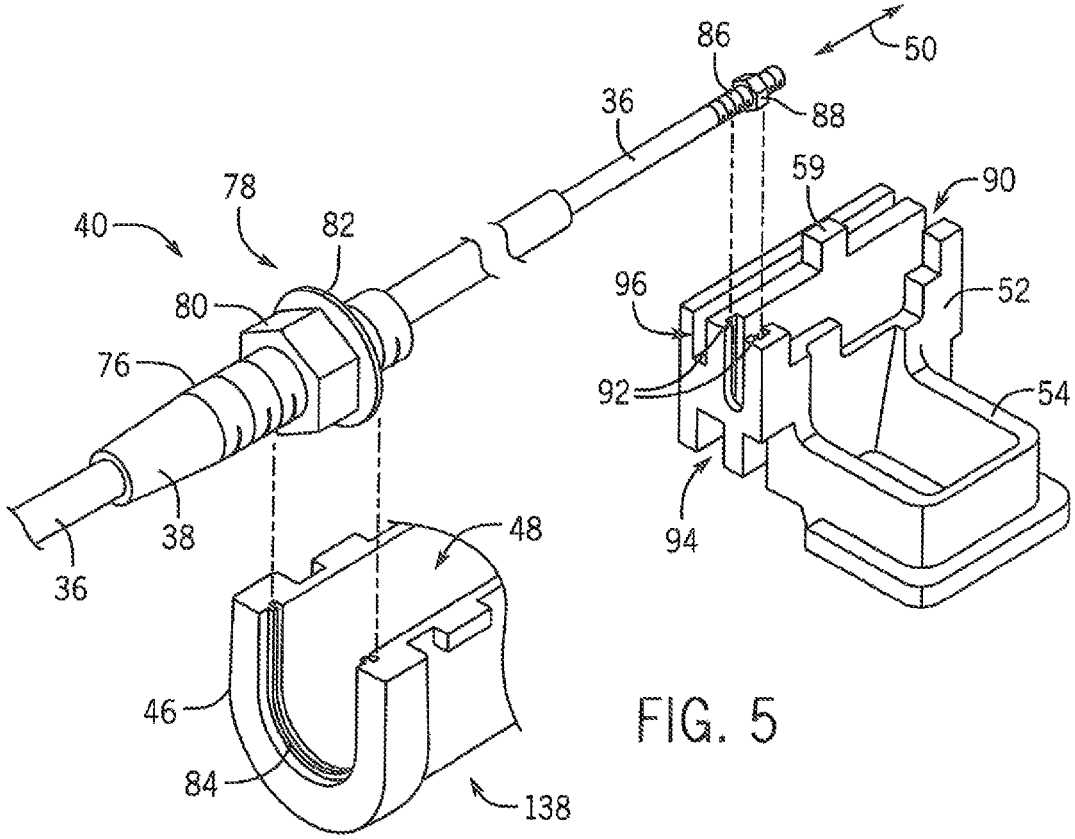
FIG. 5 is a fragmentary perspective view of an end of the actuator assembly and the slider showing interfacing of a threaded fastener on the flexible cable sheath to the actuator assembly and a lock nut on the flexible cable to the slider.

Referring now to FIG. 5, the end of the cable assembly 40 which is attached to the actuator frame 46 may provide a threaded ferrule 76, for example, crimped to an outer surface of the sheath 38 to present threads on its outer diameter. A threaded fastener 78 comprising, for example, a hex nut 80 having a radially projecting circular flange 82 attached at one face of the hex nut 80 may be received on the threaded ferrule 76. The hex nut 80 may, in one example, provide for opposed flats receivable by a standard open end wrench and separated by three-quarters of an inch or approximately 19 mm to be readily adjusted with common wrench sizes.

The radially projecting circular flange 82 may be substantially cylindrical like a washer and of greater diameter than the diameter of a circle circumscribing the flats of the hex nut 80. For example, the circular flange 82 may have a diameter of 1 inch and an axial thickness of approximately 9/16 of an inch. The lower end of the actuator frame 46 may provide a U-shaped groove 84 of equal diameter to the circular flange 82 that may receive the circular flange 82 while allowing the hex nut 80 to extend outward from the actuator frame 46 to be readily accessible. The U-shaped groove 84 is sized to permit free rotation of the circular flange 82 therein but to substantially resist translation of the circular flange along the actuation axis 50.

It will be appreciated that rotation of the threaded fastener 78 will move the threaded fastener along the threaded ferrule 76 adjusting the relative point of attachment of the sheath 38 to the actuator frame 46 as will be discussed further below. When the actuator frame cover 58 of FIG. 3 is on the actuator frame 46, the circular flange 82 is captured between the groove 84 and underside of the actuator frame cover 58 blocking movement of the circular flange 82 against substantial upward movement and removal.

Referring still to FIG. 5, the end of the flexible cable 36 extending from the sheath 38 within the channel 48 may be threaded with threads 86 to receive a lock nut 88 designed to stay substantially fixed on the threads 86 once the lock nut 88 and threads 86 are engaged. A wide variety of lock nuts of this type are known including those with jamming threads or deforming features that engage the threads 86. The lock nut 88 may be received within a channel 90 of the slider 52 opening upward and having laterally extending slots 92 that capture the axially opposed faces of the lock nut 88 against movement along actuation axis 50 with respect to the slider 52. Thus, movement of the flexible cable 36 within the sheath 38 will move the slider 52.

Figure 6:
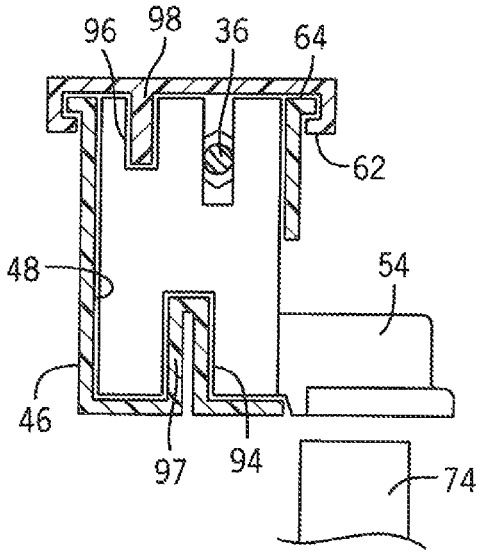
FIG. 6 is a cross-sectional view along line 6-6 to of FIG. 4 showing opposed channels in the slider and rails on the actuator frame and actuator cover for guiding the slider.

Referring now also to FIG. 6, the slider 52 may have a lower axial channel 94 and upper axial channel 96 on opposed lowering upper faces of the slider 52 extending generally parallel to the actuation axis 50. The lower axial channel 94 and upper axial channel 96 may each engage a corresponding axial guide rail 97 with axial guide rail 97 extending upward from a bottom of the channel 48 of the actuator frame 46 and guide rail 98 extending downward from the underside of the actuator frame cover 58. These two rails 97 and 98 provide a low friction interface of plastic on plastic allowing smooth sliding action of the slider 52 within the channel 48 of the actuator frame 46 and resist any rocking or torquing action that might jam or cam the two surfaces.

Figure 7:
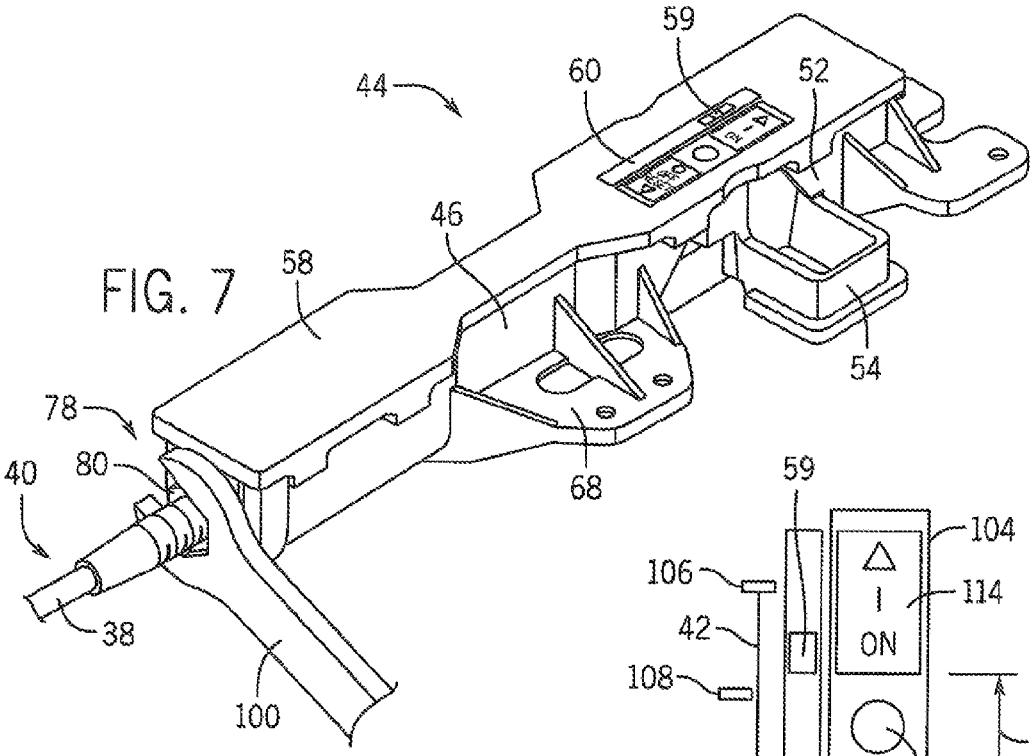
FIG. 7 is a perspective view of the assembled actuator assembly showing location of a wrench during the tuning process which may be accomplished with a simple adjustment of the threaded fastener alone.
Figure 8:
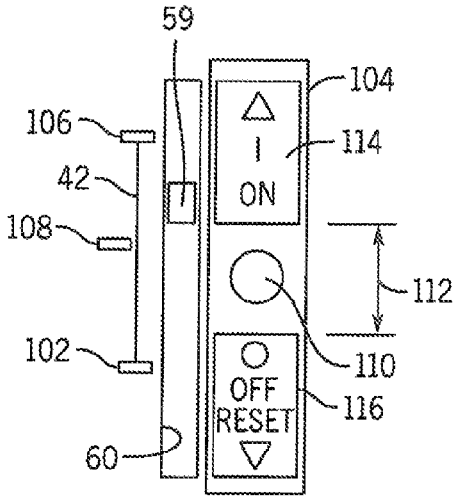
FIG. 8 is a top plan view of a label on the cover for identifying the position of the slider within the actuator assembly visible through a slot next to the label.

Referring now to FIGS. 7 and 8, adjustment of the threaded fastener 78 may be conducted by placing a standard open end wrench 100 on the hex nut 80 which protrudes from out of the assembled actuator frame 46 and actuator frame cover 58. This process is normally conducted by the manufacturer but can also be performed by the end-user. In order to make this adjustment, the handle 28 (shown in FIG. 1, but typically a jig when this is done in a manufacturing environment) may be moved to the "off" position and an off extreme point 102 may be established with respect to a visual scale 104 printed on an upper surface of the actuator frame cover 58 along slot 60 through which the fiducial feature 59 may be viewed. The off extreme point 102 may be a center point of the fiducial feature 59 when the handle 28 is in the "off" position.

The handle 28 may then be moved to the "on" position and the on extreme point 106 established with respect to the scale 103. The predefined distance 42 will be the distance between the on extreme point 106 and the off extreme point 102. The threaded fastener 78 may then be adjusted to move a center point 108 between the off extreme point 102 and on extreme point 106 to be approximately centered at a center point 110 of the visual scale 104. The tuned assembly is then sent to the user who normally need not adjust the threaded fastener 78 on-site.

The visual scale 104 includes a dead zone 112 about the center point 110 indicating the region where the position of the toggle operator 74 shown in FIG. 4 cannot reliably be known to be in either the "on" or "off" position because of normal manufacturing tolerances in the operation of the electrical switch 14, play between the collar 54 and the toggle operator 74, play between the axial location of the actuator frame cover 58 and the actuator frame 46 and other tolerance factors. Above the dead zone 112 will be an on zone 114 indicating a position of the fiducial feature 59 when the electrical switch 14 is reliably in the on state. This on zone 114 may be marked with a color red, indicating the hazard of active electrical components within the cabinet 10, and the symbols for the on state including the international symbol of an I and the word "on". Below the dead zone 112 will be an off zone 116 which may be labeled in a green color and include the international symbol for off of O, the word "off" and the word "reset".

Figure 9:
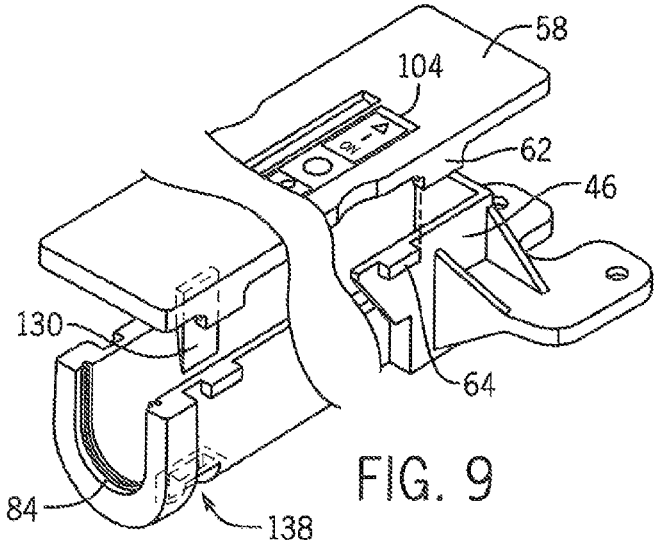
FIG. 9 is a fragmentary exploded view of the actuator frame and the actuator cover showing interlocking hooks that allow assembly of the two with a simple sliding motion.
Figure 10:
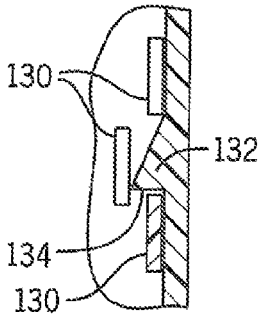
FIG. 10 is a schematic top plan diagram of the locking tab showing its operation.

Referring now to FIGS. 9 and 10, the configuration of the components described above greatly simplifies assembly of the actuator assembly 44, flexible cable assembly 40, and handle assembly 24 as well as assembly within a system as shown in FIG. 1 including electrical switch 14 and cabinet 10.

In that assembly process conducted at the manufacturer, the actuator frame 46 is first attached to the switch 14 as discussed above with respect to FIG. 4 and as indicated by process block 120. At this time, both the actuator frame cover 58 and the cable assembly 40 may be removed making this attachment process relatively simple by eliminating the weight and/or torque imparted by these additional components.

As indicated by process block 122, the threaded fastener 78 may then be assembled onto the threaded ferrule 76 as shown in FIG. 5 and the lock nut 88 may be attached to the threads 86 on the flexible cable 36 as shown in FIG. 5.

At process block 124, the slider 52 may be inserted into the channel 48 so that the collar 54 fits around the toggle operator 74 as shown in FIG. 4. Per process block 126, the threaded fastener 78 may then be inserted into the groove 84 of the actuator frame 46 and, as indicated by process block 128, the actuator frame cover 58 installed on the actuator frame 46 and the nut 88 inserted into the slots 92 of the slider 52. it will be understood that in some cases these steps may be duplicated by the end-user in the event of repair or tuning.

Referring now to FIGS. 6 and 9, the installation of the actuator frame cover 58 on the actuator frame 46 may be accomplished by simply placing the actuator frame cover 58 down against the upper edge of the actuator assembly 44 so that the hooks 62 may pass past the hook 64 discussed above with respect to FIG. 3. The actuator frame cover 58 may then be moved axially to engage hooks 62 and 64 which serve to prevent lifting off of the actuator frame cover 58.

The actuator frame cover 58 may include a downwardly extending lock tab 130 that passes over a locking ramp 132 on an inner vertical wall of the actuator frame 46 near groove 84. As shown in FIG. 10, axial sliding of the actuator frame cover 58 moves the lock tab 130 over the interior ramp 132 causing it to deflect inward and then spring outward against the perpendicular face 134 of the ramp 132 preventing retraction of the actuator frame Cover 58 under normal use. Retraction of the actuator frame cover 58 can be provided by the insertion of a screwdriver blade 135 through an aperture 138 in the bottom of the channel 48 of the actuator frame 46 to pry the lock tab 130 over ramp 132 allowing the actuator frame cover 58 to be released.

Referring again to FIG. 10, in a final step 129, the handle 28 may be positioned successively in its "on" and "off" positions and the threaded fastener 78 adjusted as described above with respect to FIG. 8.

Referring now to FIGS. 1, 11, and 12, in one embodiment, a lock aperture 138 may be provided in one vertical wall of the actuator frame 46 providing a transverse path 135 perpendicular to actuation axis 50 through aperture 138 and opening 56 in the actuator frame 46. This transverse path 135 allows for the insertion of the shank 136 of a padlock 137 through the actuator assembly 44. In a first position 139*a*, the shank 136 may pass through a transverse slot 140 in the slider 52, when the slider 52 is in the off position, to lock the slider 52 against motion that would allow movement of the collar 54 or the toggle operator 74 (shown in FIG. 4).

Alternatively, in a second position 139*b*, the aperture 138 may be moved to position 134' so that the shank 136 of the padlock 137 may pass adjacent to an upper wall of the slider 52 to prevent movement of the slider 52 toward the "on" position, yet without requiring slot 140.

As shown in FIG. 11, a body 142 of the padlock 137 may be positioned on either side of the frame 46 for flexible access to a key slot or combination operator of the padlock 137. The use of a padlock 137 directly on the actuator assembly 44 provides additional security against inadvertent activation of the switch 14, the latter as may he accessible through the cabinet door 20 when the handle 28 is in the "off" position.

Referring to FIG. 13, the collar 54 may provide an opening 144 through which the toggle operator 74 extends that narrows downward toward the electrical switch 14, like a funnel, to the substantially equal opening with two times the width of the toggle operator 74 at its entrance into the collar 54. In this way, the collar 54 not only serves to move the toggle operator 74 but, when locked, prevents movement of the toggle operator 74 while still accommodating the pivoting action of the toggle operator 74.

A lower portion of the collar 54 may be expanded in a flange 146 to provide a stabilizing surface that rests against the upper surface of the switch 14 for improved stability. Generally, in the locked position, the machine screws 66 (shown in FIG. 4) will still be accessible allowing removal of the actuator assembly 44 in the event of an inability to remove the padlock at a time when recommissioning of the switches is desired.

Certain terminology is used herein for purposes of reference only and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

We claim:

1. A switching apparatus for an electrical switch as may be disposed in a cabinet, the electrical switch having a switch operator extending from a front of a housing of the electrical switch movable along an actuation axis to switch the electrical switch between an on and off state, the switching apparatus comprising:

an actuator frame fixable relative to the housing of the electrical switch proximate to the switch operator;

a slider held by the actuator frame to slide along the actuation axis, the slider providing a collar receiving the switch operator when the actuator frame is fixed to the housing of the electrical switch, so that movement of the slider along the actuation axis may switch the switch operator between the on and off states;

an actuator cable providing an outer sheath and inner flexible cable, a first end of the outer sheath attached to one end of the actuator frame so that the inner flexible cable may extend from the first end along the actuation axis, and a first end of the inner flexible cable attached to the slider may move the slider with movement of the inner flexible cable;

wherein an attachment between the first end of the outer sheath and the actuator frame provides a threaded ferrule at the first end of the actuator sheath threadably engaging a threaded fastener adjustable therealong and wherein at least a portion of the threaded fastener is received within a pocket on the actuator frame, the pocket sized to permit rotation of the threaded fastener about the threaded ferrule within the pocket while preventing translation of the threaded fastener along the axis with respect to the actuator frame.

2. The switching apparatus of claim 1 wherein the threaded fastener provides a substantially circular disk portion having opposed faces abutting corresponding opposed faces of the pocket.

3. The switching apparatus of claim 2 wherein the threaded fastener further includes a nut portion coaxially attached to the substantially circular disk portion and providing wrench-engaging flats.

4. The switching apparatus of claim 3 wherein the nut portion is a hex nut with three-quarter inch separated flats (19 mm).

5. The switching apparatus of claim 2 wherein the pocket provides a U-shaped slot conforming to an outer periphery of the substantially circular disk portion of the threaded fastener.

6. The switching apparatus of claim 3 further including an actuator frame cover fitting over the pocket to retain the substantially circular disk portion within the pocket and wherein the nut portion extends axially beyond the actuator frame and actuator frame cover when fitting over the pocket to be accessible with a wrench.

7. The switching apparatus of claim 6 wherein at least one of the actuator frame and actuator frame cover provide a viewable scale proximate to a fiducial feature of the slider, the scale indicating a first range of positions of the slider corresponding to switching of the switch operator in the on state and a second range of positions corresponding to switching of the switch operator in the off state.

8. The switching apparatus of claim 7 wherein the first range of operator positions is marked in red with at least one of symbols for "I" and on and the second range of operator positions is marked in green with at least one of symbols for O, off, or reset.

9. The switching apparatus of claim 7 wherein the scale further provides a range of positions between the first and second range of positions indicating the position where the switch operator is not well defined in either of the on or off state.

10. The switching apparatus of claim 7 wherein the scale is on the actuator frame cover and the fiducial feature is a finger extending from the slider through a slot in the actuator frame cover or along either right or left side of the actuator frame cover adjacent to the viewable scale.

11. The switching apparatus of claim 9 wherein the actuator frame cover engages the actuator frame by an axial slidable engagement of corresponding hooks.

12. The switching apparatus of claim 11 wherein the scale further provides a third range of positions between the first and second range of positions indicating the position where the switch operator is not well defined in either of the on or off state and wherein the third range is equal to no less than a sum of an axial tolerance between the actuator frame and the actuator frame cover and an axial tolerance between the collar and the switch operator.

13. The. switching apparatus of claim 7 Wherein at least a portion of the threaded fastener is exposed through. the assembled actuator frame cover and actuator frame at a position to be manipulated by a user viewing the scale.

14. The switching apparatus of claim 1 wherein the outer sheath and inner cable are substantially resistant to extension in tension and contraction in compression.

15. The switching apparatus of claim 1 further including handle mechanism that is mountable to a cabinet surface having a handle frame and a handle movable with respect to the handle frame between a first position and a second position and wherein a second end of the outer sheath is attached the handle frame and the second end of the inner flexible cable is attached to the handle so that movement of the handle between the first position and second position move the slider in a range sufficient to switch the switch operator between the on and off states.

16. The switching apparatus of claim 1 wherein the actuator frame is injected molded thermoplastic.

17. The switching apparatus of claim 1 wherein the actuator frame includes outer flange portions having holes for receiving machine screws to attach the actuator frame to the electrical switch.

18. An electrical switching station for controlling electrical power comprising:

a cabinet providing an interior volume accessible through a cabinet door when the cabinet doors open;

at least one electrical switch attached to the cabinet within the interior volume, the electrical switch having a switch operator extending from a front of a housing of the electrical switch and movable along an actuation axis to switch the electrical switch between an on and off state;

an actuator frame fixable relative to the housing of the electrical switch proximate to the switch operator;

a slider held by the actuator frame to slide along the actuation axis, the slider providing a collar receiving the switch operator when the actuator frame is fixed to the housing of the electrical switch, so that movement of the slider along the actuation axis may switch the switch operator between the on and off states;

an actuator cable providing an outer sheath and inner flexible cable, a first end of the outer sheath attached to one end of the actuator frame so that the inner flexible cable may extend from the first end along the actuation axis and a first end of the inner flexible cable attached to the slider to most the slider with movement of the inner flexible cable;

wherein the attachment between the first end of the outer sheath and the actuator frame provides a threaded ferrule at the first end of the actuator sheath threadably engaging a threaded fastener adjustable therealong and wherein at least a portion of the threaded fastener is received within a pocket on the actuator frame, the pocket sized to permit rotation of the threaded fastener about the threaded ferrule within the pocket while preventing translation of the threaded fastener along the axis with respect to the actuator frame;

a handle mechanism attached to the cabinet surface and having a handle frame and a handle movable with respect to the handle frame between an on position and an off position, the handle mechanism holding the door in a closed position when the handle is in the on position;

and wherein a second end of the outer sheath is attached to the handle frame and the second end of the inner flexible cable is attached to the handle so that movement of the handle between the first position and second position moves the slider in a range sufficient to switch the switch operator between the on and off states.

19. A method of adjusting an electrical switch as may be disposed in a cabinet having a door, the electrical switch having a switch operator extending from a front of a housing of the electrical switch movable along an actuation axis to switch the electrical switch between an on and off state, using an apparatus including:

an actuator frame fixable relative to the housing of the electrical switch proximate to the switch operator;

a slider held by the actuator frame to slide along the actuation axis, the slider providing a collar receiving the switch operator when the actuator frame is fixed to the housing of the electrical switch, so that movement of the slider along the actuation axis may switch, the switch operator between the on and off states;

an actuator cable providing an outer sheath and inner flexible cable, a first end of the outer sheath attached to one end of the actuator frame so that the inner flexible cable may extend from the first end along the actuation axis and a first end of the inner flexible cable attached to the slider to move the slider with movement of the inner flexible cable;

wherein the attachment between the first end of the outer sheath and the actuator frame provides a threaded ferrule at the first end of the actuator sheath threadably engaging a threaded fastener adjustable therealong and wherein at least a portion of the threaded fastener is received within a pocket on the actuator frame, the pocket sized to permit rotation of the threaded fastener about the threaded ferrule within the pocket while preventing translation of the threaded fastener along the axis with respect to the actuator frame;

a handle mechanism attached to the cabinet surface and having a handle frame and a handle movable with respect to the handle frame between an on position and an off position, the handle mechanism holding the door in a closed position when the handle is in the on position;

and wherein a second end of the outer sheath is attached to the handle frame and the second end of the inner flexible cable is attached to the handle so that movement of the handle between the first position and second position moves the slider in a range sufficient to switch the switch operator between the on and off states; and a viewable scale proximate to a fiducial feature of the slider, the scale indicating a first range of positions of the slider corresponding to switching of the switch operator in the on state and a second range of positions corresponding to switching of the switch operator in the off state, the method comprising the steps of.

(a) positioning the handle in a first of the on and off positions and observing a first position of the fiducial feature of the slider;

(b) positioning the handle in a second of the on and off positions and observing a second position of the fiducial feature of the slider; and (c) rotating the threaded fastener to position a center point of the first and second positions at a center point between the first and second ranges.

* * * * *

UNITED STATES PATENT AND TRADEMARK OFFICE

CERTIFICATE OF CORRECTION

PATENT NO. : 9,177,731 B2
APPLICATION NO. : 14/078187
DATED : November 3, 2015
INVENTOR(S) : Shawn D. Cloran et al.

It is certified that error appears in the above-identified patent and that said Letters Patent is hereby corrected as shown below:

IN THE CLAIMS

CLAIM 13, Col. 11, Line 12

Delete "The. switching apparatus of claim 7 Wherein at least a" and substitute therefor -- The switching apparatus of claim 7 wherein at least a --

CLAIM 18, Col. 11, Line 58

Delete "slider to most" and substitute therefor

-- slider to move --

Signed and Sealed this
Twenty-third Day of February, 2016

Michelle K. Lee

Michelle K. Lee
*Director of the United States Patent and Trademark Office*